US005944384A

United States Patent [19]

Patterson

[11] Patent Number: 5,944,384

[45] Date of Patent: Aug. 31, 1999

[54] SUN FOLLOWING SWIVEL BEACH CHAIR

[76] Inventor: Steve Patterson, 90 Bermuda St., Atlantic Beach, N.Y. 11509

[21] Appl. No.: 08/864,216

[22] Filed: May 24, 1997

[51] Int. Cl.[6] ..... A47C 1/02

[52] U.S. Cl. ..... 297/344.23; 297/217.3; 297/115; 297/124; 297/188.18; 297/184.1; 297/16.1; 297/344.18

[58] Field of Search ..... 297/344.26, 344.23, 297/184.11, 184.1, 16.1, 16.2, 119, 120, 217.3, 411.34, 34, 36, 344.18, 391, 452.29, 188.18, 188.14, 115, 124, DIG. 6, 354.13, 423.19

[56] References Cited

U.S. PATENT DOCUMENTS

| | | | |
|---|---|---|---|
| 4,379,588 | 4/1983 | Speice | 297/344.23 X |
| 4,544,202 | 10/1985 | Keaton | 297/344.26 X |
| 4,824,170 | 4/1989 | Goldmeier . | |
| 4,842,335 | 6/1989 | Wunderlich . | |
| 5,046,782 | 9/1991 | Lundeen . | |
| 5,078,451 | 1/1992 | Sobel . | |
| 5,297,304 | 3/1994 | O'Sullivan | 297/397 X |
| 5,395,157 | 3/1995 | Rollo et al. . | |
| 5,494,333 | 2/1996 | Wilson | 297/344.18 |
| 5,536,068 | 7/1996 | Valentor et al. | 297/344.18 |
| 5,829,832 | 11/1998 | Molee et al. | 297/397 |
| 5,845,962 | 12/1998 | Lin | 297/16.1 X |

FOREIGN PATENT DOCUMENTS

| | | | |
|---|---|---|---|
| 461188 | 8/1951 | Italy | 297/411.34 |

*Primary Examiner*—Milton Nelson, Jr.
*Attorney, Agent, or Firm*—Michael I. Kroll

[57] ABSTRACT

A sun following swivel beach chair (10) comprising a structure (12) for supporting a person at rest. A facility (14) is for elevating the supporting structure (12) off the ground (16). An assembly (18) within the elevating facility (14) is for rotating the supporting structure (12) about a vertical axis three hundred and sixty degrees, so that the person in the supporting structure (12) can follow the movement of the sun (20) in the sky, to receive rays (22) from the sun (20) for suntanning purposes.

24 Claims, 8 Drawing Sheets

10
14
34
36
40
41
42
44
46
48
50
54
64
68

SUN FOLLOWING SWIVEL BEACH CHAIR

BACKGROUND OF THE INVENTION

1. Field of the Invention

The instant invention relates generally to outdoor lounge chairs and more specifically it relates to a sun following swivel beach chair. The sun following swivel beach chair will allow a person sitting thereon to rotate the chair three hundred and sixty degrees to follow the movement of the sun in the sky.

2. Description of the Prior Art

Numerous outdoor lounge chairs have been provided in prior art. For example, U.S. Pat. Nos. 4,824,170 to Goldmeier; 4,842,335 to Wunderlich; 5,046,782 to Lundeen; 5,078,451 to Sobel and 5,395,157 to Rollo et al. all are illustrative of such prior art. While these units may be suitable for the particular purpose to which they address, they would not be as suitable for the purposes of the present invention as heretofore described.

Goldmeier, Steven

Outdoor Swivel Chair

U.S. Pat. No. 4,824,170

A detachable swivel mechanism is disclosed for an outdoor chair adapted for regular or reclining use. The mechanism consists of a base, adjustable telescoping support members which may be attached to many different sizes and types of outdoor chairs and swivel means to which the telescoping members and base are connected. In one embodiment, the mechanism may have a circular base having a diameter of at least the same size as the width of the seat of the chair to which it is attached, and means at the periphery of the base providing a circular track thereon. A plurality of rigid supports may be provided to hold the seat above the circular base. Roller means are used to mount the lower end of these supports for movement along the track to permit the seat to swivel, and means overlying the circular track are used to hold the roller means on the track.

Wunderlich, Arthur K.

P.V.C. Swivel Beach Chair

U.S. Pat. No. 4,842,335

A swivel beach chair is formed from connected segments of P.V.C. pipe. Foot, back and head rest portions of the chair are pivotally adjustable. Various configurations of swivel bases are disclosed for mounting the chair for three hundred sixty degree rotation. An adjustable latching mechanism is disclosed for allowing selective adjustment of the pivotal foot, back and headrest portions of the chair.

Lundeen, Jack M.

Rotatable Sun Chair

U.S. Pat. No. 5,046,782

The rotatable sun chair includes a seat, a tubular ring beneath the seat, a plurality on angularly spaced channel-shaped brackets having their web portions secured to the underside of the seat. Each bracket has a pair of downwardly extending and laterally spaced side panels. A grooved roller is journaled for rotation between each of the pair of side panels. The lower end portions of the side panels are inturned beneath the tubular ring to prevent disengagement of each bracket from the ring. A pair of U-shaped leg units are pivotally connected to the underside of the ring. One of the leg units has an upwardly facing notch and the other of the leg units has a downwardly facing notch where the leg units intersect each other. The leg units will be maintained in a supporting relationship beneath the ring and can be folded into an adjacent relation with one side of the ring when the chair is to be transported. The chair also includes a backrest and a leg rest. These components can be folded into an adjacent relation with the other side of the ring.

Sobel, David J.

Portable Rotatable Beach Chaise Lounge

U.S. Pat. No. 5,078,451

A portable beach chaise lounge rotatable assembly is provided. The chair portion of the chaise lounge rotates about a circular track means enabling the upper portion to rotate above a stationary support portion. The upper portion rotates 360 degrees and swivels above a corresponding lower ball bearing laden circular track for smooth movement of the upper circular portion and the corresponding chaise lounge. For easy carrying, the lower support portion is attached to hinged collapsible leg portions which collapse inward towards each other in a parallel fashion in two pairs. The upper rotatable portion is supported by hinged support stanchions which collapse in a complimentary fashion such that the two pairs of support stanchions collapse in a direction parallel to each other.

Rollo, Linda

Cvecic, Elvis

Rotatable Suntanning Chair with Insulated Base

U.S. Pat. No. 5,395,157

The articulated body support includes a lower body section, a seat section and an upper body section with a head support portion. The seat section includes a frame with a circular ball bearing track. The track is mounted on top of a box-like base and allows the support to rotate relative to the base about a center pin. The base has a hollow heat insulated enclosure with an access drawer, a magazine receiving recess and a shoulder strap. The upper body section carries an accordion-like collapsible sun shield.

SUMMARY OF THE INVENTION

A primary object of the present invention is to provide a sun following swivel beach chair that will overcome the shortcomings of the prior art devices.

Another object is to provide a sun following swivel beach chair that can be rotated upon a vertical axis three hundred and sixty degrees, so that a person sitting in the chair can follow the movement of the sun in the sky.

An additional object is to provide a sun following swivel beach chair that can be folded up, so that a person can transport the chair effortlessly from place to place.

A further object is to provide a sun following swivel beach chair that is simple and easy to use.

A still further object is to provide a sun following swivel beach chair that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 1 is a front perspective view of a first embodiment of the instant invention in an opened position and place upon a sand terrain.

FIG. 1*a* is an enlarged front perspective view of an area indicated by arrow 1*a* in FIG. 1.

FIG. 1*b* is a further enlarged front perspective view of an area indicated by arrow 1*b* in FIG. 1*a,* with parts exploded, in cross section and in phantom.

FIG. 2 is a top perspective view taken in the direction of arrow 2 in FIG. 1, with the supporting structure removed therefrom.

FIG. 2*a* is an enlarged elevational view taken in the direction of arrow 2*a* in FIG. 2, with parts broken away showing the armrest hinge in greater detail.

Figures 9, 10:
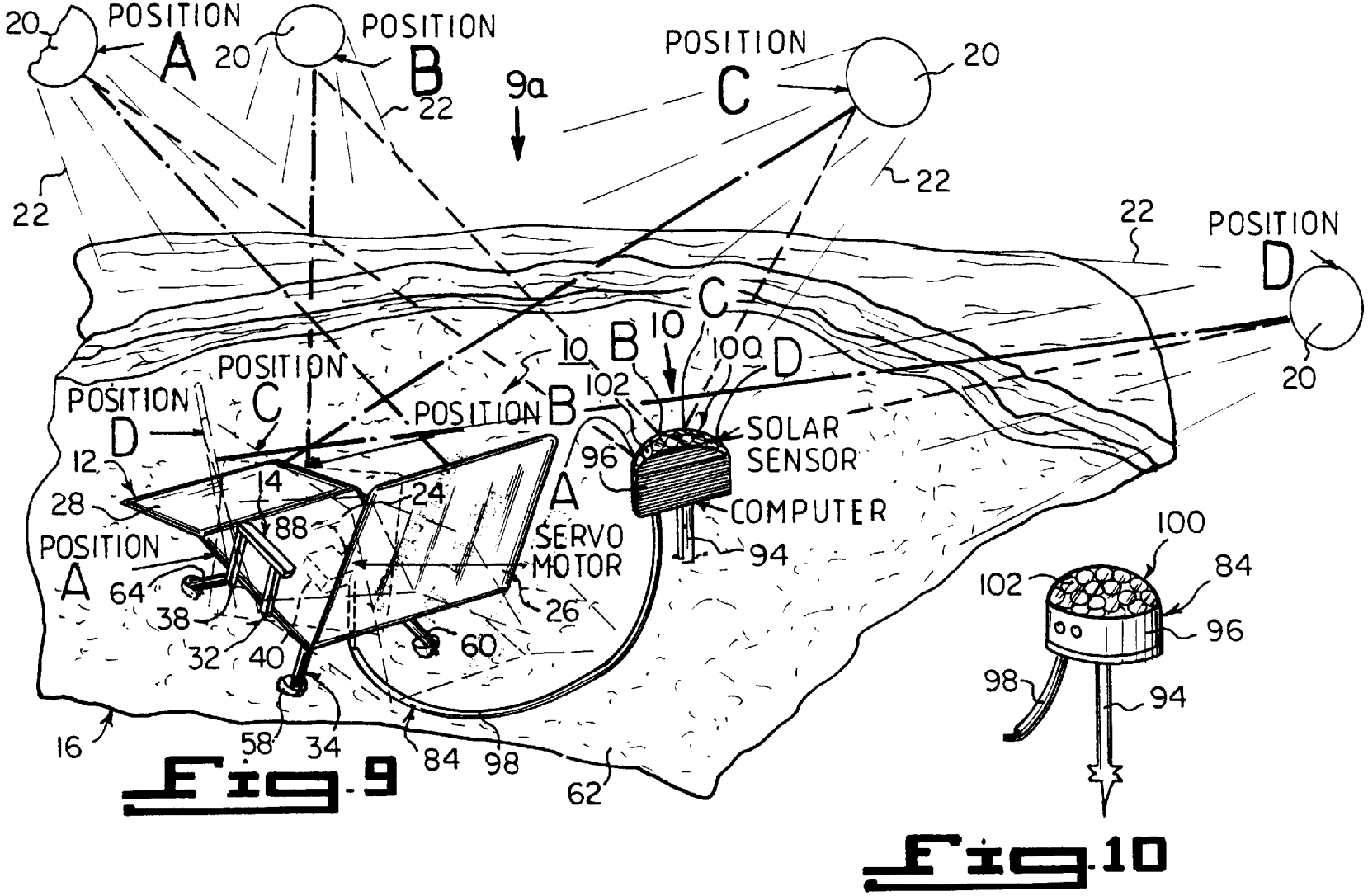
FIG. 9 is a perspective view of a third embodiment of the instant invention placed upon the sand terrain.
Figure 9A:
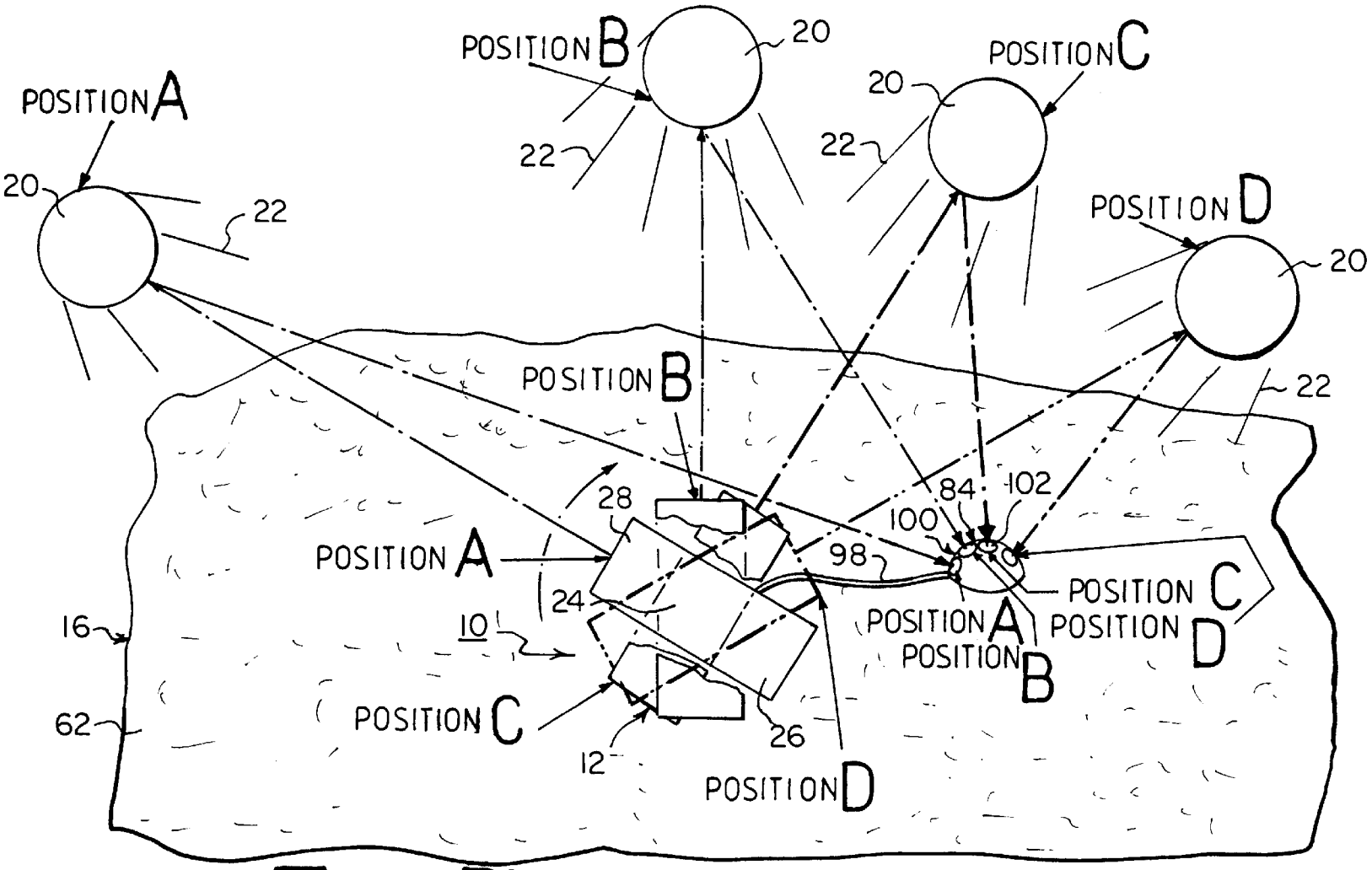

FIG. 9*a* is a diagrammatic top plan view of the third embodiment taken in the direction of arrow 9*a* in FIG. 9.

FIG. 10 is a front perspective view of the solar sensor and computer stand per se taken in the direction of arrow 10 in FIG. 9.

Similar reference characters denote corresponding features consistently throughout the attached drawings.

DETAILED DESCRIPTION OF THE PREFERRED EMBODIMENTS

Turning now descriptively to the drawings, in which similar reference characters denote similar elements throughout the several views, FIGS. 1 through 10 illustrate a sun following swivel beach chair 10 comprising a structure 12 for supporting a person at rest. A facility 14 is for elevating the supporting structure 12 off the ground 16. An assembly 18 within the elevating facility 14 is for rotating the supporting structure 12 about a vertical axis three hundred and sixty degrees, so that the person in the supporting structure 12 can follow the movement of the sun 20 in the sky, to receive rays 22 from the sun 20 for suntanning purposes.

The supporting structure 12 consists of a seat portion 24 with a backrest portion 26 extending from the seat portion 24. A leg rest portion 28 extends from the seat portion 24 opposite from the backrest portion 26. The backrest portion 26 and the leg rest portion 28 are both adjustably connected at 29 to the seat portion 24.

The elevating facility 14 includes a frame unit 32 for engagement with the seat portion 24 of the supporting structure 12. A plurality of legs 34 are provided. An assemblage 36 is for mounting the legs 34 downwardly with respect to the frame unit 32. The frame unit 32 comprises a pair of armrests 38. Each armrest 38 extends upwardly at a right angle position along one side of the seat portion 24 of the supporting structure 12.

The mounting assemblage 36 consists of a box-shaped housing 40 having an open bottom 41 with a plurality of side sockets 42 about side walls 44 of the housing 40, so that a top end 46 of each leg 34 will extend from one of the side sockets 42. Each side socket 42 is an inverted U-shaped slot 48, while each leg 34 is tubular and is pivotally mounted with a rod 50 at the top end 46 within one side socket 42, so that the top ends 46 of the legs 34 can pivot within the side sockets 42.

Figure 5:
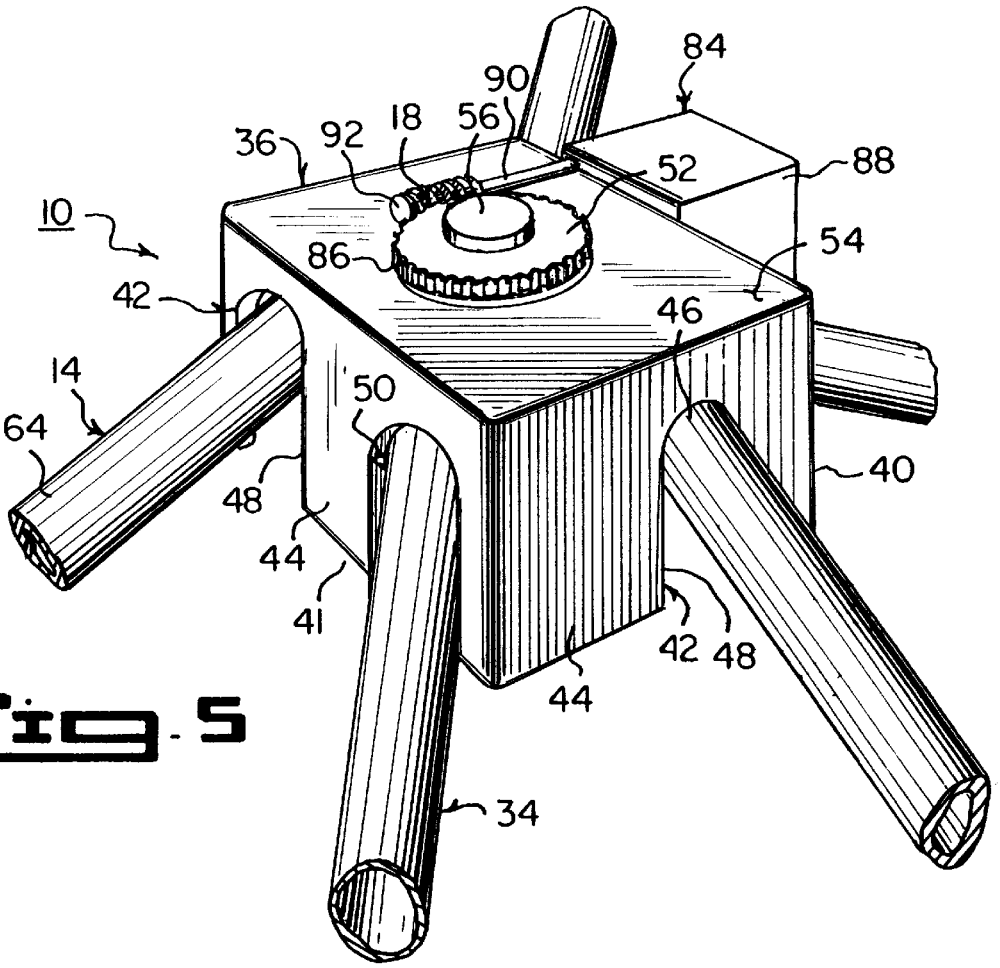
FIG. 5 is an enlarged top perspective view taken in the direction of arrow 5 in FIG. 2, with parts broken away, the frame unit removed and the telescopic legs extended therefrom.

The rotating assembly 18, as best seen in FIG. 5, consists of a swivel plate 52 that turns on a top surface 54 of the housing 40. A stub shaft 56 extends upwardly from the swivel plate 52 which engages centrally with the frame unit 32. A plurality of cup-shaped shoes 58 are provided. Each cup-shaped shoe 58 is mounted to a bottom end 60 of one leg 34, so that the legs 34 can be placed firmly upon the ground 16 which may be a sand terrain 62.

Each leg 34 is formed of a plurality of segmented telescopic parts 64 with a latch mechanism 68 between the segmented telescopic parts 64, so that each leg 34 can be extended for use and be collapsed to fold up under the housing 40 when not in use. A towel 70 is attached at one end via VELCRO tabs 71 to an upper end of the backrest portion 26 of the supporting structure 12. In a first instance, the towel 70 can be rolled up to function as a headrest for the person in the supporting structure 12. In a second instance, the towel 70 can be unrolled to function as a head cover to protect the head of the person from the rays 22 of the sun 20.

Figure 1:
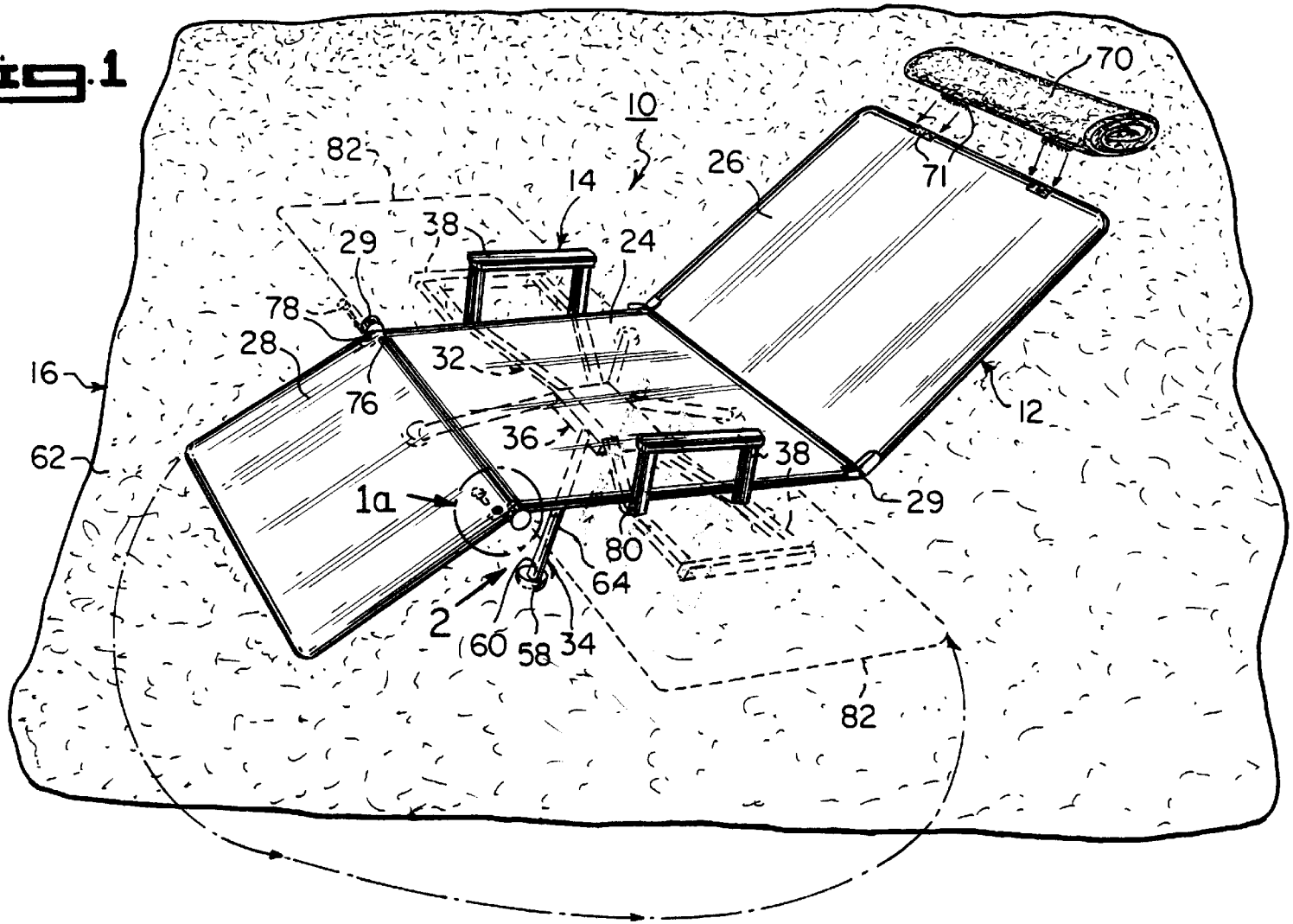
Figure 6:
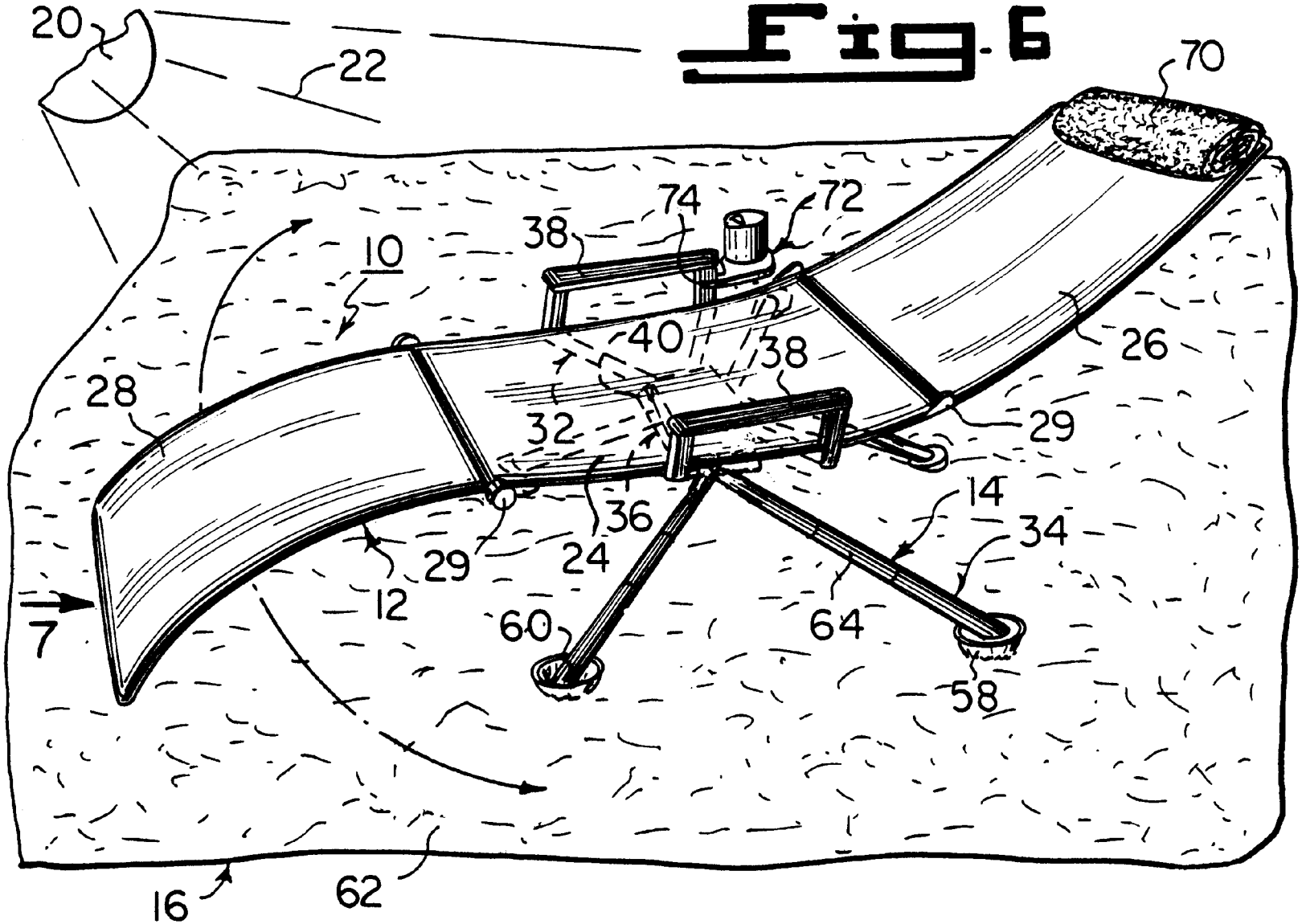
FIG. 6 is a front perspective view of a second embodiment of the instant invention in an opened position placed upon the sand terrain, showing the sun shining down.
Figure 7:
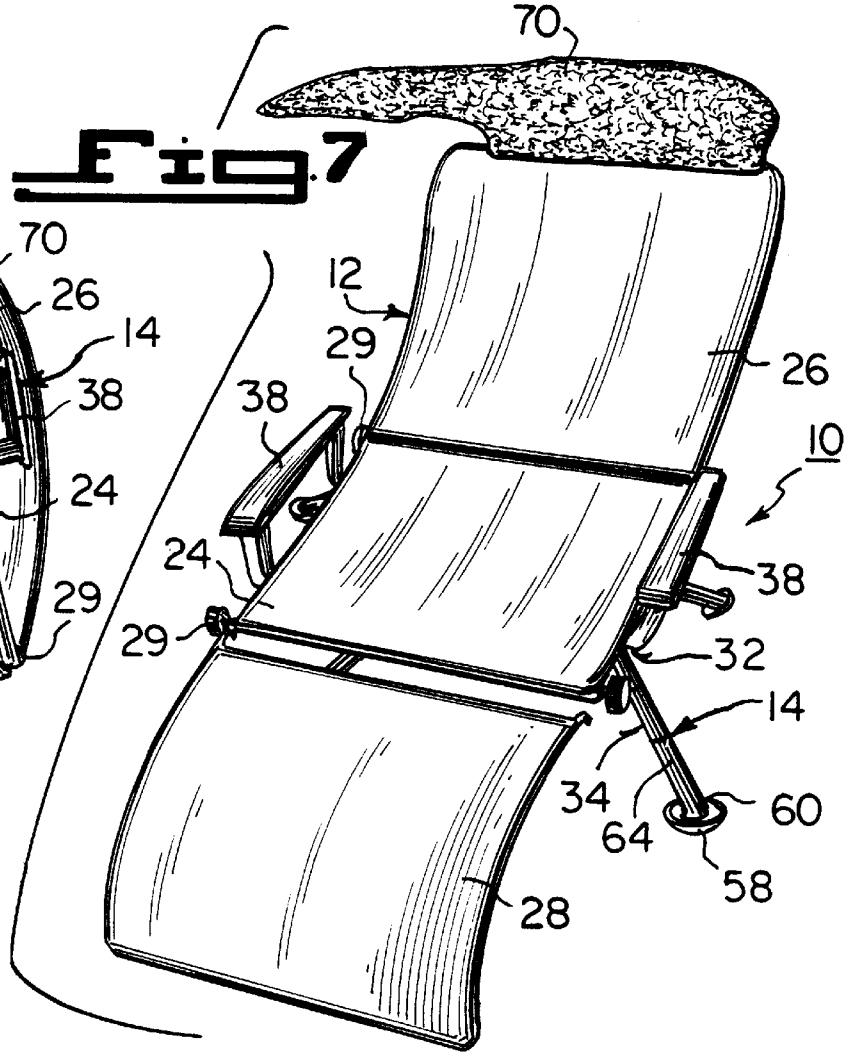
FIG. 7 is a front perspective view taken in the direction of arrow 7 in FIG. 6 of the second embodiment per se with the leg rest portion exploded therefrom and the towel unrolled to function as a head cover.
Figure 8:
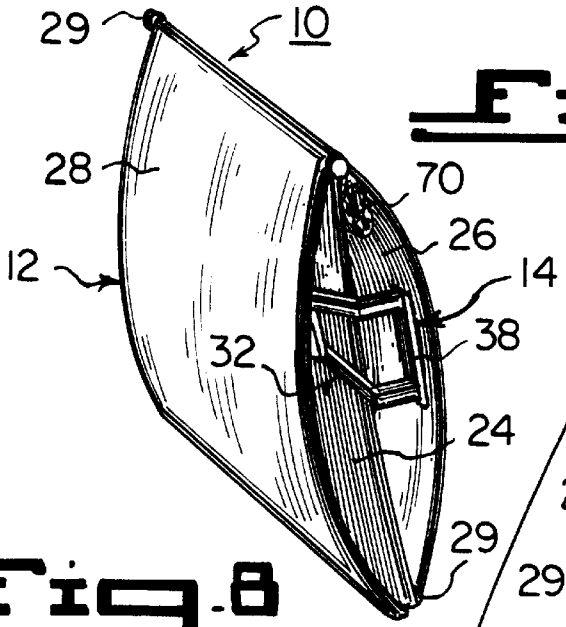
FIG. 8 is a perspective view of the second embodiment in a folded up position ready to be carried or stored.

As shown in FIG. 1, the backrest portion 26 and the leg rest portion 28 are straight. In FIGS. 6, 7 and 8, the backrest portion 26 and the leg rest portion 28 are curved. A beverage holder 72 having a clip 74 can be attachable to either of the armrests 38 of the frame unit 32, as shown in FIG. 6.

Figure 1A:
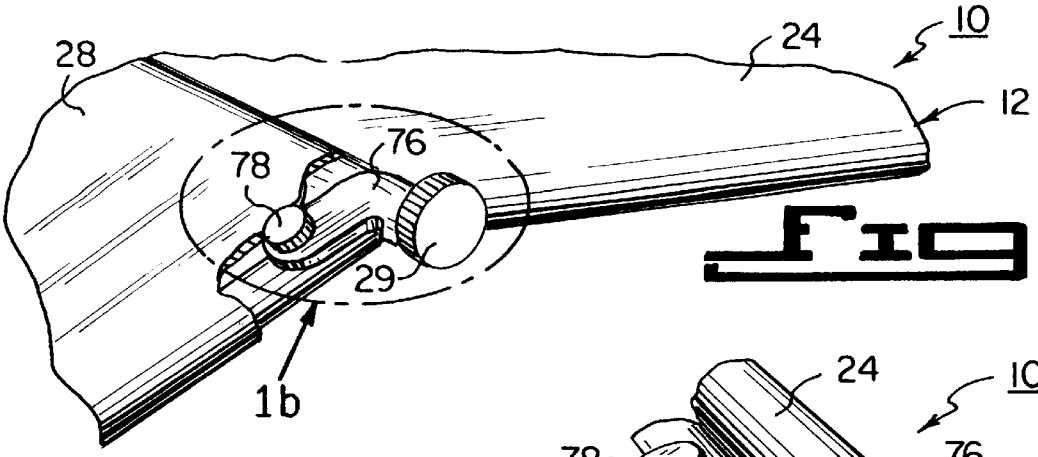
Figure 1B:
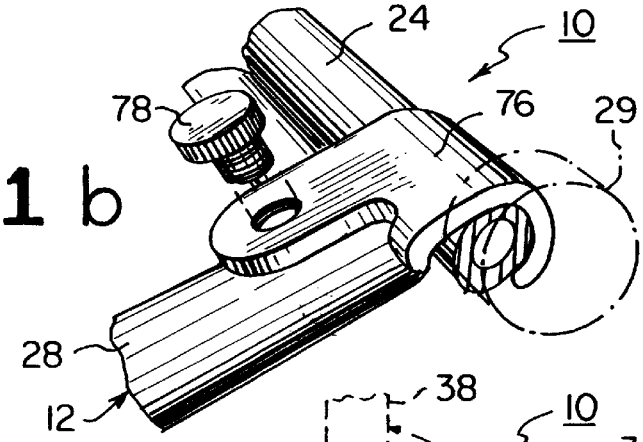
Figure 2A:
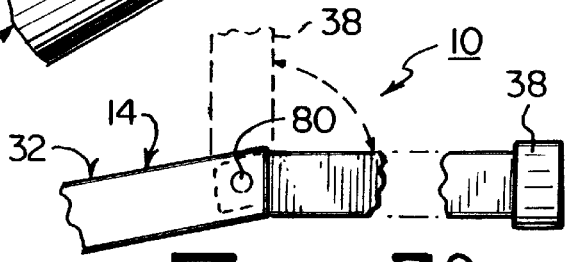
Figure 2:
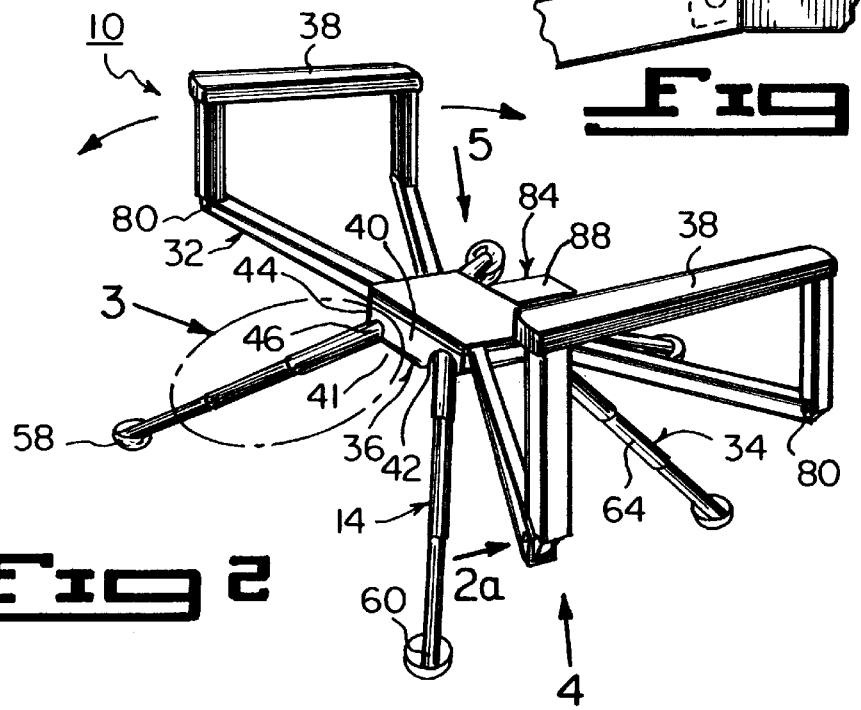
Figures 3, 4:
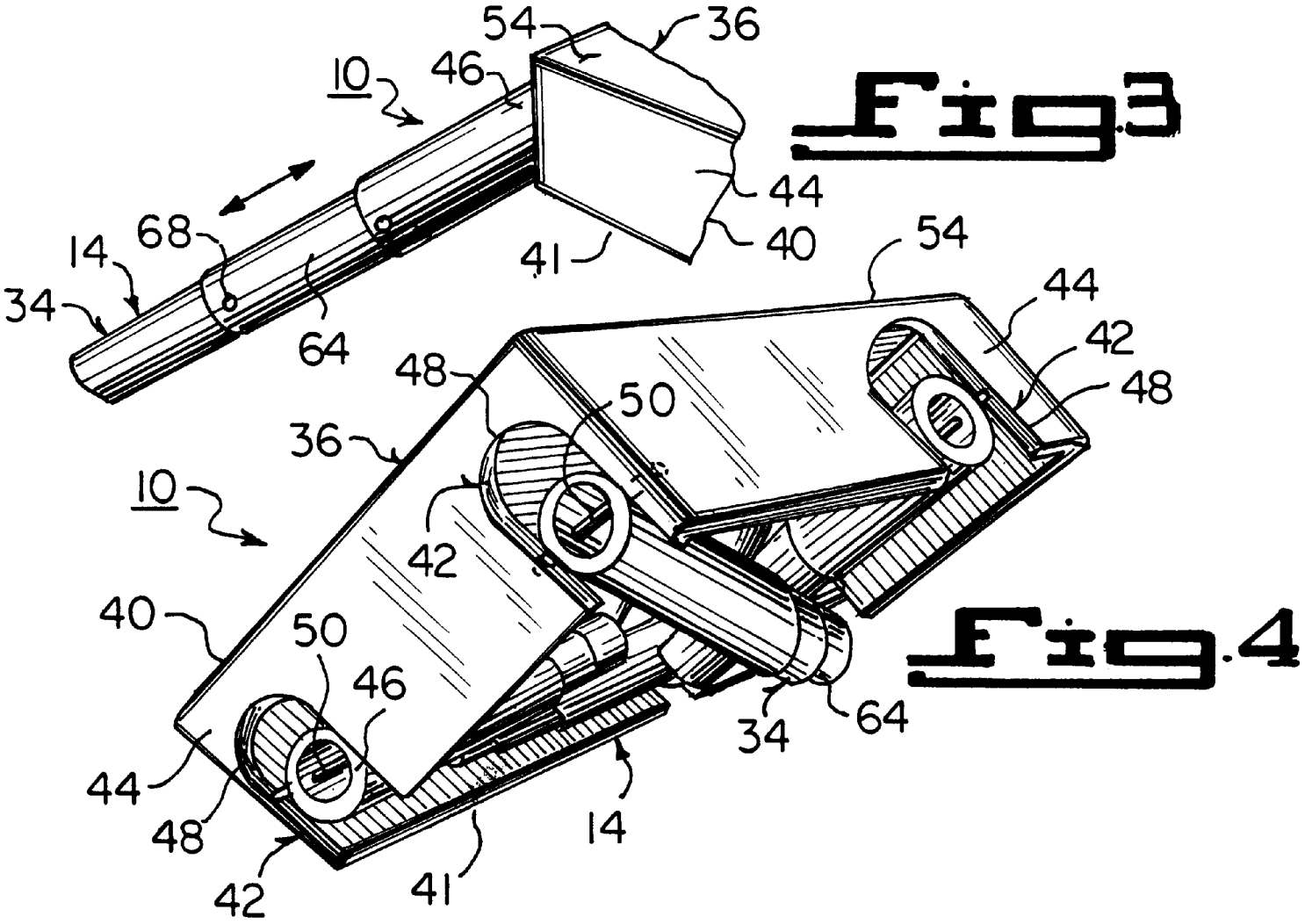
FIG. 3 is an enlarged perspective view of an area indicated by arrow 3 in FIG. 2, showing one of the telescopic legs in greater detail.
FIG. 4 is an enlarged bottom perspective view taken in the direction of arrow 4 in FIG. 2, with parts broken away, the frame unit removed and the telescopic legs folded up.

The sun following swivel beach chair 10, as shown in FIGS. 1, 1*a,* 1*b,* 2 and 2*a,* further include a pair of hook members 76. A pair of bolts 78 pivotally mount the hook members 76 to opposite corners of the leg rest portion 28, so that the hook member 76 can engage with the seat portion 24 of the supporting structure 12. The armrests 38 are hinged at 80 to the frame unit 32, so as to go between the right angle position and a horizontal position. The leg rest portion 28 can pivot about on one of the bolts 78, be supported upon one armrest 38 in the horizontal position and function as a side table top 82, as shown in dotted lines in FIG. 1.

As shown in FIGS. 2, 5, 9, 9*a* and 10, the sun following swivel beach chair 10 can further include a system 84 for automatically operating the swivel plate 52, so that the frame unit 32 will turn with respect to the position of the sun 20 in the sky. The automatically operating system 84 consists of the swivel plate 52 having gear teeth 86 about its circumference. A servo motor 88 is mounted to one side wall 44 of the housing 40. A drive shaft 90 extends from the servo motor 88 over the top surface 54 of the housing 40. A worm 92 on a distal end of the drive shaft 90 is in engagement with the gear teeth 86 on the swivel plate 52.

A spike stand 94 engages with the sand terrain 62, while a computer 96 is on the spike stand 94. An elongated electrical cord 98 is connected between the computer 96 and the servo motor 88. A solar sensor 100 on the computer 96 has a plurality of solar panels 102 that are each electrically connected to the computer 96. Each of the solar panels 102 of the solar sensor 100 activated by movement of the sun 20 will send signals to the computer 96. The computer 96 will operate the servo motor 88, to rotate the drive shaft 90 with the worm 92 and turn the gear teeth 96 on the swivel plate 52, to properly position the chair 10 with respect to the sun 20 in the sky.

To use the automatically operating system 84 as shown in FIGS. 9 and 9*a,* the sun following swivel beach chair 10 is placed in position A, while the sun 20 is in position A in the sky and shining directly on a solar panel 102 also at position A on the solar sensor 100. When the sun 20 moves to position B in the sky and shines directly on another solar panel 102 at position B on the solar sensor 100, a signal is sent to the computer 96 to operate the servo motor 88 and turn the swivel plate 52, to reposition the sun following swivel beach chair 10 to position B. The same thing will happen when the sun 20 moves to positions C and D in the sky, thereby repositioning the sun following swivel beach chair to positions C and D.

OPERATION OF THE INVENTION

To use the sun following swivel beach chair 10, the following steps should be taken:

1. Place the cup-shaped shoes 58 on the bottom ends 60 of the legs 34 upon the ground 16, which is the sand terrain 62.
2. Adjust the angle of the backrest portion 26 of the supporting structure 12.
3. Adjust the angle of the leg rest portion 26 of the supporting structure 12.
4. Have the person sit upon the seat portion 24 of the supporting structure 12.
5. Rest the head of the person upon the rolled up towel 70.
6. Turn the supporting structure 12 by the rotating assembly 18 with the elevating facility 14, so that the rays 22 from the sun 20 will be properly directed onto the person for the suntanning purposes.
7. Unroll the towel 70 and cover the head of the person and manually turn the supporting structure 12 away from the rays 22 from the sun 20 if the person does not want to suntan.

LIST OF REFERENCE NUMBERS

10 sun following swivel beach chair
12 supporting structure of 10
14 elevating facility of 10 for 12
16 ground
18 rotating assembly of 10 in 14
20 sun
22 ray of 20
24 seat portion of 12
26 backrest portion of 12
28 leg rest portion of 12
29 adjustment connection for 26 and 28 to 24
32 frame unit of 14
34 leg of 14
36 mounting assemblage of 14
38 armrest of 32
40 box-shaped housing of 36
41 open bottom of 40
42 side socket in 40
44 side wall of 40
46 top end of 34
48 inverted U-shaped slot for 42
50 rod on 46
52 swivel plate of 18
54 top surface of 40
56 stub shaft of 18 on 52
58 cup-shaped shoe on 60
60 bottom end of 34
62 sand terrain for 16
64 segmented telescopic part of 34
68 latch mechanism in 64
70 towel on 26
71 VELCRO tab between 70 and 26
72 beverage holder
74 clip on 72 for 38
76 hook member of 10
78 bolt of 10 for 76 in 28
80 hinge for 38 in 32
82 side table top for 28
84 automatically operating system for 10
86 gear teeth of 84 on 52
88 servo motor of 84
90 drive shaft on 88
92 worm on 90
94 spike stand of 84
96 computer on 94
98 elongated electrical cord between 96 and 88
100 solar sensor on 96
102 solar panel of 100

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by letters patent is set forth in the appended claims:

1. A sun following swivel beach chair comprising:

a) means for supporting a person at rest, said supporting means including a seat portion; a backrest portion extending from said seat portion; and a leg rest portion extending from said seat portion opposite from said backrest portion;

b) means for elevating said supporting means off the ground, said elevating means including a frame unit including a pair of arm rests, each armrest extending upwardly at a right angle position along one side of said seat portion of said supporting means, said frame unit engaging said seat portion of said supporting means; a plurality of legs; and means for mounting said legs downwardly with respect to said frame unit;

c) means within said elevating means, for rotating said supporting means about a vertical axis three hundred and sixty degrees, so that the person in said supporting means can follow the movement of the sun in the sky, to receive rays from the sun for suntanning purposes;

d) a pair of hook members;

e) a pair of bolts for pivotally mounting said hook members to opposite corners of said leg rest portion, so that said hook members can engage with said seat portion of said supporting means; and f) said armrests hinged to said frame unit, so as to go between the right angle position and a horizontal position, to allow said leg rest portion to pivot about on one of said bolts, be supported upon one said armrest in the horizontal position and function as a side table top.

2. A sun following swivel beach chair as recited in claim 1, further including a plurality of shoes, in which each said shoe is mounted to a bottom end of one said leg, so that said legs can be placed firmly upon the ground which may be a sand terrain.

3. A sun following swivel beach chair as recited in claim 1, wherein each said leg is formed of a plurality of segmented telescopic parts with a latch mechanism between said segmented telescopic parts, so that each said leg can be extended for use and be collapsed to fold up under said housing when not in use.

4. A sun following swivel beach chair as recited in claim 1, further including a towel attached at one end to an upper end of said backrest portion of said supporting means, so that in a first instance said towel can be rolled up to function as a headrest for the person in said supporting means, and in a second instance said towel can be unrolled to function as a head cover to protect the head of the person from the rays of the sun.

5. A sun following swivel beach chair as recited in claim 1, wherein said backrest portion and said leg rest portion are straight.

6. A sun following swivel beach chair as recited in claim 2, wherein said backrest portion and said leg rest portion are curved.

7. A sun following swivel beach chair as recited in claim 1, further including a beverage holder having a clip attachable to either of said armrests of said frame unit.

8. A sun following swivel beach chair as recited in claim 1, wherein said mounting means includes a housing having an open bottom with a plurality of side sockets about side walls of said housing, so that a top end of each said leg will extend from one of said side sockets.

9. A sun following swivel beach chair as recited in claim 8, wherein each said side socket is an inverted U-shaped slot, while each said leg is tubular and is pivotally mounted at said top end within one said side socket, so that said top ends of said legs can pivot within said side sockets.

10. A sun following swivel beach chair as recited in claim 8, wherein said rotating means includes:

a) a swivel plate that turns on a top surface of said housing; and b) a stub shaft extending upwardly from said swivel plate which engages centrally with said frame unit.

11. A sun following swivel beach chair as recited in claim 10, further including means for automatically operating said swivel plate, so that said frame unit will turn with respect to the position of the sun in the sky.

12. A sun following swivel beach chair as recited in claim 11, wherein said automatically operating means includes:

a) said swivel plate having gear teeth about its circumference;

b) a servo motor mounted to one said side wall of said housing;

c) a drive shaft extending from said servo motor over said top surface of said housing;

d) a worm on a distal end of said drive shaft in engagement with said gear teeth on said swivel plate;

e) a spike stand to engage with a sand terrain;

f) a computer on said spike stand;

g) an elongated electrical cord connected between said computer and said servo motor; and h) a solar sensor on said computer having a plurality of solar panels each electrically connected to said computer, so that each of said solar panels of said solar sensor activated by movement of the sun will send signals to said computer, to operate said servo motor to rotate said drive shaft with said worm and turn said gear teeth on said swivel plate to properly position said chair with respect to the sun in the sky.

13. A sun following swivel beach chair as recited in claim 1, wherein said backrest portion and said leg rest portion are both adjustably connected to said seat portion.

14. A sun following swivel beach chair as recited in claim 13, wherein said mounting means includes a housing having an open bottom with a plurality of side sockets about side walls of said housing, so that a top end of each said leg will extend from one of said side sockets.

15. A sun following swivel beach chair as recited in claim 14, wherein each said side socket is an inverted U-shaped slot, while each said leg is tubular and is pivotally mounted at said top end within one said side socket, so that said top ends of said legs can pivot within said side sockets.

16. A sun following swivel beach chair as recited in claim 15, wherein said rotating means includes:

a) a swivel plate that turns on a top surface of said housing; and b) a stub shaft extending upwardly from said swivel plate which engages centrally with said frame unit.

17. A sun following swivel beach chair as recited in claim 16, further including a plurality of shoes, in which each said shoe is mounted to a bottom end of one said leg, so that said legs can be placed firmly upon the ground which may be a sand terrain.

18. A sun following swivel beach chair as recited in claim 17, wherein each said leg is formed of a plurality of segmented telescopic parts with a latch mechanism between said segmented telescopic parts, so that each said leg can be extended for use and be collapsed to fold up under said housing when not in use.

19. A sun following swivel beach chair as recited in claim 18, further including a towel attached at one end to an upper end of said backrest portion of said supporting means, so that in a first instance said towel can be rolled up to function as a headrest for the person in said supporting means, and in a second instance said towel can be unrolled to function as a head cover to protect the head of the person from the rays of the sun.

20. A sun following swivel beach chair as recited in claim 19, wherein said backrest portion and said leg rest portion are straight.

21. A sun following swivel beach chair as recited in claim 19, wherein said backrest portion and said leg rest portion are curved.

22. A sun following swivel beach chair as recited in claim 19, further including a beverage holder having a clip attachable to either of said armrests of said frame unit.

23. A sun following swivel beach chair as recited in claim 19, further including means for automatically operating said swivel plate, so that said frame unit will turn with respect to the position of the sun in the sky.

24. A sun following swivel beach chair as recited in claim 23, wherein said automatically operating means includes:

a) said swivel plate having gear teeth about its circumference;

b) a servo motor mounted to one said side wall of said housing;

c) a drive shaft extending from said servo motor over said top surface of said housing;

d) a worm on a distal end of said drive shaft in engagement with said gear teeth on said swivel plate;

e) a spike stand to engage with said sand terrain;

f) a computer on said spike stand;

g) an elongated electrical cord connected between said computer and said servo motor; and h) a solar sensor on said computer having a plurality of solar panels each electrically connected to said computer, so that each of said solar panels of said solar sensor activated by movement of the sun will send signals to said computer, to operate said servo motor to rotate said drive shaft with said worm and turn said gear teeth on said swivel plate to properly position said chair with respect to the sun in the sky.

* * * * *